US010171906B1

(12) United States Patent
Lee et al.

(10) Patent No.: US 10,171,906 B1
(45) Date of Patent: Jan. 1, 2019

(54) CONFIGURABLE MICROPHONE ARRAY AND METHOD FOR CONFIGURING A MICROPHONE ARRAY

(71) Applicant: Sennheiser electronic GmbH & Co. KG, Wedemark (DE)

(72) Inventors: Michael Lee, San Carlos, CA (US); Marios Athineos, San Francisco, CA (US)

(73) Assignee: Sennheiser electronic GmbH & Co. KG, Wedemark (DE)

( * ) Notice: Subject to any disclaimer, the term of this patent is extended or adjusted under 35 U.S.C. 154(b) by 0 days.

(21) Appl. No.: 15/800,864

(22) Filed: Nov. 1, 2017

(51) Int. Cl.
*H04R 3/00* (2006.01)
*H04R 1/40* (2006.01)

(52) U.S. Cl.
CPC ..... *H04R 1/406* (2013.01); *H04R 3/005* (2013.01); *H04R 3/00* (2013.01)

(58) Field of Classification Search
CPC ..... H04R 3/00; H04R 3/005; H04R 1/406
See application file for complete search history.

(56) References Cited

U.S. PATENT DOCUMENTS 7,092,763 B1 8/2006 Griffith et al.
2014/0226838 A1* 8/2014 Wingate ..... G10L 21/0272 381/111
2016/0012827 A1 1/2016 Alves et al.
2017/0004818 A1* 1/2017 Khatua ..... H04R 29/005
2017/0111504 A1* 4/2017 Khor ..... H04M 3/5175
2017/0135407 A1* 5/2017 Cameron ..... A24F 47/008
2017/0164101 A1 6/2017 Rollow, IV et al.

FOREIGN PATENT DOCUMENTS

EP 1 465 455 10/2004

OTHER PUBLICATIONS

International Search Report for Application No. PCT/EP2018/070382 dated Sep. 10, 2018.
Written Opinion for Application No. PCT/EP2018/070382 dated Sep. 10, 2018.

* cited by examiner

*Primary Examiner* — Disler Paul
(74) *Attorney, Agent, or Firm* — Haug Partners LLP

(57) ABSTRACT

Microphone arrays with automatic beam focusing may easily focus on disturbing sound sources. In order to prevent this unwanted behavior, a predefined control sound signal is replayed from a direction of a disturbing sound source. The microphone array detects the predefined control sound signal, determines the direction of replay and in response performs a re-configuration according to the control sound signal. The reconfiguration may comprise eliminating the direction from its scanning range or cancel a previously made elimination of a different direction.

16 Claims, 3 Drawing Sheets

CONFIGURABLE MICROPHONE ARRAY AND METHOD FOR CONFIGURING A MICROPHONE ARRAY

The invention relates to microphone arrays, and in particular to microphone arrays that use automatic beam focusing.

BACKGROUND

Microphone arrays use a plurality of microphone capsules, and combine output signals of the microphone capsules in order to obtain a specific directivity of the microphone array in a particular direction. The direction of an audio source can be detected mainly by analyzing delays between audio signals arriving at each microphone capsule. Correspondingly, a directivity of the microphone array can be implemented by combining delayed microphone output signals, and the direction can be controlled by modifying the respective delays.

Microphone arrays may use automatic beam focusing in order to automatically adjust their directivity towards a speaker. For example, the microphone array may determine a direction of the speaker by determining a direction of maximum sound input. In a practical approach, the microphone array may scan sound signals from different predetermined directions of a given scan area. It may pick up and compare energies of sound signals from these directions, determine a direction of maximum sound energy and adjust the delays for its microphone capsules so as to adjust its directivity into the determined direction. Such microphone array is described e.g. in US 2017/0164101 A1.

However, this may lead to a problem if there is a sound source within the scanned area which is not intended to be picked-up by the microphone array. For example, disturbing sound may be heard through an open window or open door. For microphone arrays that are installed e.g. in conference rooms, the disturbing sound sources may be electronic devices, such as a beamer, a loudspeaker or an air conditioner. Particularly if the disturbing sound source is near the microphone array, or in moments of silence when no person is speaking, the audio signal emitted by the disturbing sound source may irritate the microphone array. The disturbing sound may be the signal of maximum energy within the scan area, so that the microphone array focuses on the disturbing sound source. The microphone array will then refocus very often, which may decrease its signal quality, and may even pick up the sound emitted by the disturbing sound source and amplify it.

SUMMARY OF THE INVENTION

Therefore a problem to be solved is how to prevent a microphone array with automatic beam focusing from focusing on disturbing sound sources at known positions.

At least this problem is solved by a method for configuring a microphone array according to claim 1 and by a microphone array according to claim 8.

According to the invention, a predefined control sound signal is replayed from a direction of a disturbing sound source. The control sound signal may be regarded as an audio signature. The method comprises the microphone array detecting the predefined control sound signal, determining the direction of replay and in response performing a reconfiguration of the microphone array according to the control sound signal. The reconfiguring may comprise e.g. eliminating the direction from its scanning range or cancelling a previously made elimination of a different direction.

A configurable microphone array according to an embodiment of the invention comprises a plurality of microphone capsules adapted for operating as an array that has a configurable directivity, a directivity control unit adapted for controlling the configurable directivity of the microphone array, and a configuration control unit adapted for determining that a sound signal detected by the microphone capsules corresponds to a predefined control sound signal, and further adapted for configuring the directivity control unit according to the control sound signal.

Advantageously, the invention provides a convenient and user-friendly solution to assist in rapid configuration of microphone arrays, and in particular to mark region boundaries of microphone arrays, in order to enable the microphone array to apply different processing for different regions of pick up. The provided solution is fast and easy to use. The exclusion of regions (exclusion sectors) significantly reduces error rates of microphone arrays.

Further advantageous embodiments are disclosed in the drawings and in the detailed description.

DETAILED DESCRIPTION

Figure 1:
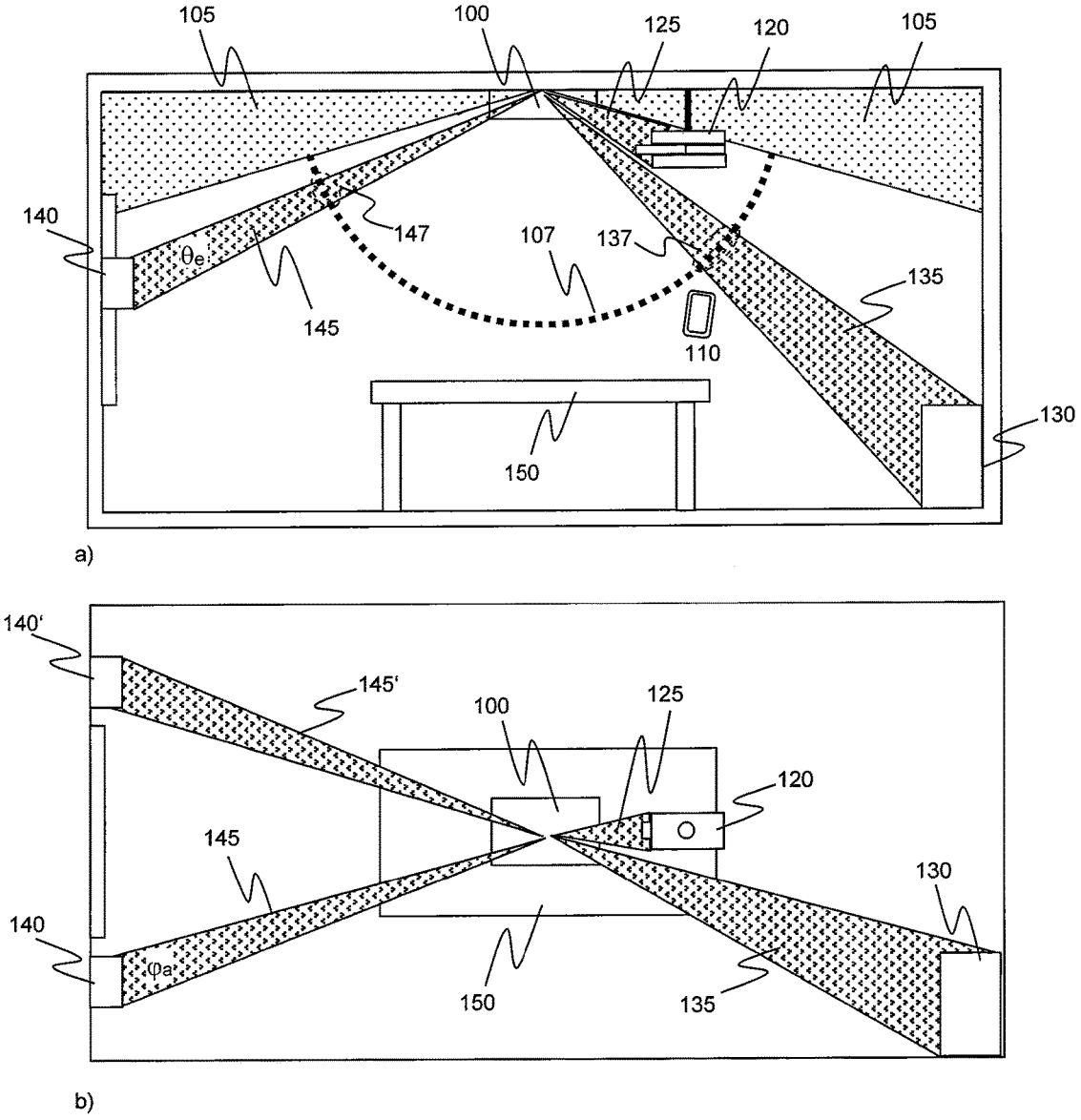
FIG. 1 a conference room with a ceiling mounted microphone array and disturbing sound sources.

FIG. 1 shows exemplarily a conference room with a ceiling mounted configurable microphone array 100 and some disturbing sound sources, for example a beamer 120, an air conditioner 130 and a pair of loudspeakers 140,140'. The microphone array 100 is in this example mounted centrally in the room, above a meeting table 150. FIG. 1 a) is a schematic side view of the conference room while FIG. 1 b) is a schematic top view thereof. The microphone array 100 may initially scan sound signals from all directions within its scan range or pick up range. For this it may use various different techniques, e.g. a grid of probe points 107. There may also be a range 105 that is by default excluded, usually because it is outside the microphone array's pick up range. While the operation of conventional microphone arrays may be disturbed by unwanted noise of the various sound sources 120,130,140, the present invention provides a simple solution for specifically excluding one or more disturbing sound sources from the microphone array's pick up range: A user may place a portable electronic device 110 that is suitable for sound reproduction, such as a smart phone, between the configurable microphone array 100 and a disturbing sound source 130 and cause the portable electronic device 110 to reproduce a specific sound signal. For example, this may be a recorded sound signal or a sound signal that is produced according to a computer program.

The microphone array 100 detects the sound signal and the spatial direction from which it receives the sound signal, e.g. an elevation angle and an azimuth angle. If the microphone array 100 uses a grid of probe points 107, it may also detect the respective probe point or probe points instead of angles. In either case, each pair of spatial angles or each probe point may represent a spatial sector, which corresponds to a spatial resolution that is achievable by the microphone array.

The sound signal is specific in that is comprises a coded information or audio signature, e.g. it may be a particular melody, a sequence of particular tones, or any sound that comprises a particular modulation or a particular audio watermark. The sound signal may use an audible frequency range, but may at least partially also an ultrasonic frequency range. The microphone array 100 may decode this information by determining that the detected sound signal corresponds to a predefined control sound signal. In response thereto, the microphone array 100 performs a (re-) configuration, preferably a (re-) configuration with respect to beam steering and spatial directions.

Various kinds of (re-) configuration can be used. For example, the detected spatial direction from which the sound signal was received may be excluded from the search range that the microphone array 100 uses for scanning sound signals. In this case, it is easy and very simple for a user to exclude disturbing sound sources from the microphone array's search range: in the example shown in FIG. 1, the user may place the portable device 110 between the microphone array 100 and an air conditioner 130. While the portable device 110 replays a specific sound signal that the microphone array 100 decodes into "exclude this sector", the microphone array 100 may exclude the sector, or a probe point or group of probe points 137 defining the sector, from its search range. It will store this information until it is cancelled. In an embodiment, the microphone array may automatically exclude also adjacent sectors from which it receives noise during the configuration process. It is also possible to control the size of an exclusion sector by holding the portable device 110 closer to the microphone array 100 (for larger sectors) or farther from the microphone array 100 (for smaller sectors). The user may repeat this procedure for other disturbing sound sources. The microphone array will then create and store exclusion sectors for each of them, e.g. a first exclusion sector 125 towards a beamer 120, a second exclusion sector 135 towards an air conditioner 130 and a third and fourth exclusion sector 145,145' towards wall mounted loudspeakers. While FIG. 1 a) shows elevation angles $\theta_e$ of the exclusion sectors, FIG. 1 b) shows azimuth angles $\varphi_a$ thereof. For example, exclusion sectors 145,145' for a pair of wall mounted loudspeakers 140,140' may have the same elevation angle, but different azimuth angles.

As another example, a sector that the microphone array previously excluded from its search range may be re-incorporated in the search range. This is useful e.g. in cases where a disturbing sound source has been moved, or an erroneous configuration was made. In an embodiment, all previous exclusions of search regions may be cancelled by a single signal.

As yet another example, the microphone array may be configured such that any modified processing will be applied to sound signals that come from the detected spatial direction, e.g. an amplification factor for them may be modified.

In an embodiment, the portable device 110 may replay one of a plurality of different specific predefined sound signals that correspond to different instructions and that the microphone array 100 may decode into these instructions, such e.g. as "exclude this sector", "re-include adjacent excluded sectors" or "re-include all excluded sectors". In another embodiment, the portable device 110 may replay also one or more specific predefined sound signals that correspond to other instructions for configuring the microphone array 100, and the microphone array 100 may decode into these instructions.

Note that each probe point 107,127,137 represents a beam with a particular elevation angle range and azimuth angle range, or a beam through the microphone array and the probe point respectively, and the portable electronic device 110 may be placed anywhere along this beam. However, since the spatial resolution increases with distance from the microphone array, the respective amount of concerned spatial sectors may be smaller if the portable device 110 is farther apart, and larger if the portable device 110 is closer to the microphone array 100.

Preferably, the sound signal reproduced by the portable electronic device 110 is a synthesized electronic signal and not a speech signal. This is advantageous since it prevents irritation due to multiple different speech signals that might be detected simultaneously. Moreover, signal analysis is simplified since speech signals are more difficult to analyze.

Figure 2:
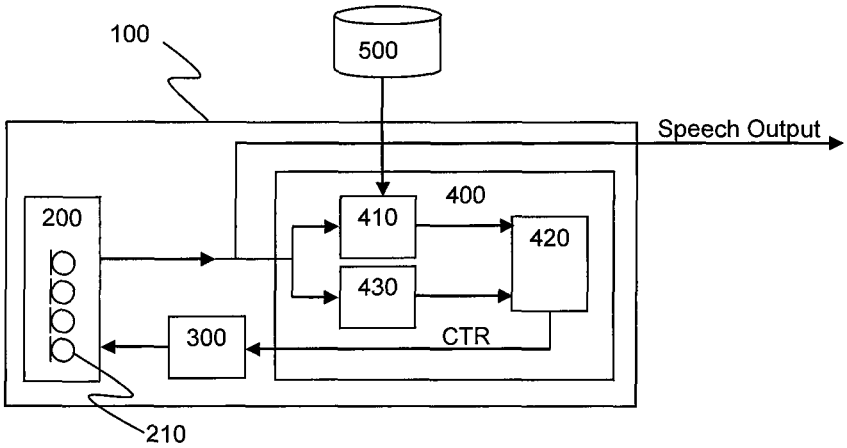
FIG. 2 an overview of a microphone array according to an embodiment of the invention.

FIG. 2 shows a structure of a microphone array, in one embodiment. The microphone array 100 comprises an array 200 of a plurality of microphone capsules 210 that has a configurable directivity, a directivity control unit 300, and a configuration control unit 400. The directivity control unit 300 is adapted for controlling the configurable directivity of the microphone array. The configuration control unit 400 is adapted for determining that a sound signal detected by the array 200 of microphone capsules corresponds to a first predefined control sound signal. The configuration control unit 400 is further adapted for configuring the directivity control unit 300 according to the first predefined control sound signal. At least the configuration control unit 400 may be implemented by one or more processors, such as signal processing units. In the depicted embodiment, the array 200 comprises delay elements for microphone signals picked up by the microphone capsules 210, and therefore may have a directivity. The delay elements are configurable and the directivity control unit 300 provides control signals for the delay elements. The output signal of the array 200 may be provided to further processing (not shown) for speech output, e.g. filtering. In another embodiment, delay elements may be comprised in the directivity control unit 300 or in a separate unit, and the configuration control unit 400 receives input from the directivity control unit 300 or the separate unit, respectively. Thus, the directivity control unit 300 may be integrated into the array 200. In this case, the output signal of the directivity control unit 300 or the separate unit may be provided to further processing for speech output.

In the embodiment depicted, the configuration control unit 400 comprises a comparator unit 410, a direction detection unit 430 and a control signal generating unit 420. The comparator unit 410 is adapted for comparing the sound signal detected by the array of microphones 200 with at least one predefined control sound signal, and for determining that the detected sound signal corresponds to the first predefined control sound signal. The direction detection unit 430 is adapted for detecting a first direction from which the sound signal is detected. The control signal generating unit 420 is adapted for generating a first electronic control signal CTR according to the first predefined control sound signal. The first electronic control signal CTR configures the directivity control unit 300 according to the first direction.

In an embodiment, the microphone array 100 comprises or is connected to a storage unit 500 that may store data defining one or more predefined control sound signals. In this case, the configuration control unit 400 may compare the detected sound signal (or specific parameter data thereof)

with the one or more predefined control sound signals (or parameter data thereof) stored in the storage unit 500, and determine that the detected sound signal corresponds to said first predefined control sound signal. This may be done by the comparator unit 410. In response, the configuration control unit 400 may generate the first electronic control signal CTR according to the first predefined control sound signal. The first electronic control signal (re-) configures the directivity control unit 300.

There are various types of configuration of the directivity control unit 300 that can be performed by the configuration unit 400. In an embodiment, configuring the directivity control unit by the configuration unit comprises configuring the directivity control unit to generate a directivity of the microphone array such that it omits the first direction, i.e. the direction from which the sound signal was received. In cases where scanning for sound sources is a separate process, this may mean that at least this process will be omitted in the first direction. It may also mean that any sound coming from sound sources in the first direction will be ignored. In another embodiment, the directivity control unit may be configured to suspend scanning for sound sources and remain focused to the current region. In yet another embodiment, the directivity control unit may be configured to cancel a previously made configuration, such as an omission of a second direction in the directivity of the microphone array. In this case, the second direction is different from the first direction, since the microphone array omits at least scanning the first direction for sound signals due to the previously made current configuration.

As described above, the first and second directions mark spatial regions, and therefore may be regarded as region markings. A further possible application for region markings is to assist remote-side speaker identification or speaker labelling. For example, labels may be included as metadata in the audio signal.

Figure 3:
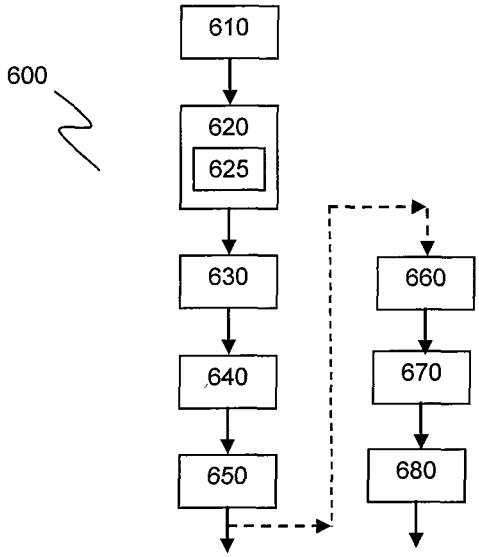
FIG. 3 a flowchart of a method according to an embodiment of the invention.

FIG. 3 shows a flowchart of a method for configuring a microphone array, in an embodiment. The method 600 is performed by the microphone array and comprises scanning 610 sound signals from a plurality of directions by an array of microphone capsules, detecting 620 a sound signal from a first direction and detecting 625 the first direction, determining 630 that the detected sound signal corresponds to a first predefined control sound signal, generating 640 a first electronic control signal according to the first predefined control sound signal, and configuring 650 the microphone array according to the first electronic control signal. The scanning 610 for sound signals may be performed sequentially or simultaneously for a plurality of directions. In an embodiment, the determining 630 that the detected sound signal corresponds to a first predefined control sound signal may also be implemented as determining 630 that the detected sound signal comprises a signature according to a first predefined control signature. In this case, the first electronic control signal is generated according to the first predefined control signature.

In an embodiment, the configuring 650 comprises eliminating the first direction from scanning sound signals. In another embodiment, the configuring 650 comprises limiting the scanning of sound signals to the first direction, so that other directions than the first direction are not scanned for sound signals. In an embodiment, the configuring 650 comprises cancelling a current configuration, such as cancelling an elimination of a second direction from scanning sound signals, wherein the second direction is different from the first direction. In another embodiment, a computer with a user interface (such as a screen and input keys) and control software may be used to cancel a previously specified configuration, such as e.g. an elimination of any direction from scanning.

In an embodiment, the method 600 further comprises determining 660 that the detected sound signal corresponds to a second predefined control sound signal different from the first predefined sound signal, generating 670 a second electronic control signal according to the second predefined control sound signal, and configuring 680 the microphone array according to the second electronic control signal. The configuring 680 according to the second electronic control signal may comprise at least modifying a processing of sound signals coming from the first direction, such as modifying an amplification of the sound signals coming from the first direction. In an embodiment, the determining 660 that the detected sound signal corresponds to a second predefined control sound signal may also be implemented as determining that the detected sound signal comprises a signature according to a second predefined control signature. In this case, the second electronic control signal is generated according to the second predefined control signature.

In an embodiment, determining 630,660 that the detected sound signal corresponds to a predefined control sound signal comprises comparing parameters of the detected sound signal with stored parameters of the predefined control sound signal.

In an embodiment, the electronic device is a portable computer or a smart phone. The control sound signal or signals may be reproduced via a software program, such as an app. In an embodiment, a user may use a sound generating device, such as an app installed on a smartphone or tablet, to generate and emit structured audible signals that a microphone array can interpret to mark regions in its field of pickup. For example, a structured audible signal may comprise a signature for "mark region". The user simply places the emitting device in a region to mark and commences the emission of the proper audio containing the signature. To unmark a region, the user may e.g. place the emitting device in a region adjacent to the marked region and commence the emission of an audio containing a signature for "unmark neighbor regions". This may cancel a previously made region marking of a neighbor region. In an embodiment, the signature is coded in a way to reflect user defined labels. The microphone array then uses this information to either mask or ignore certain regions, or apply different processing to each region. Thus, the user experience is improved and simplified compared to conventional graphical manipulation techniques. Moreover, the invention reduces the chance of error, and can be used indoor, other than e.g. GPS based systems. Another advantage over GPS based systems or solutions based on computer vision technology, the mobile electronic device 110 does not need an additional communication channel back to the microphone array.

In an embodiment, the invention relates to a non-transitory computer-readable storage medium having stored thereon instructions that when executed on a computer cause the computer to perform a method for configuring a microphone array as disclosed above.

Figure 4:
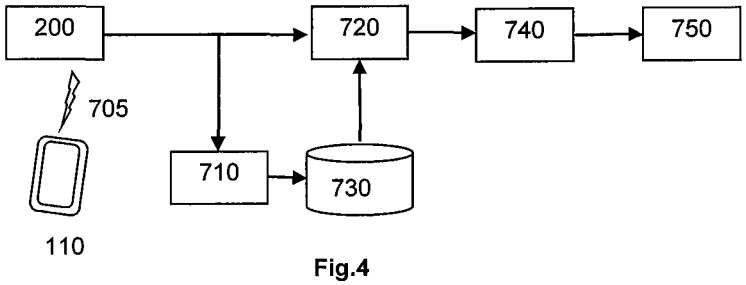
FIG. 4 a single-channel masking structure.

FIG. 4 shows a structure of an exemplary single-channel masking application, wherein a spatially aware signal detector is configured to ignore specific spatial areas. Thereby only signals that are in unmarked regions may pass. For configuration, a region data generator software running on a portable device 110 generates an audio signal 705, which is detected by an array of microphone capsules 200. The array 200 provides corresponding audio data to a region audio data parser 710 and a spatially aware signal detector 720.

The region audio data parser 710 feeds a region database 730. The spatially aware signal detector 720 receives also input from the region database 730. It performs beam steering, thereby focusing the beam and extracting an audio signal from the focused beam. Then it provides the audio signal to a signal processor 740, which performs audio processing to the signal, such as e.g. filtering. Finally, the processed audio signal is passed 750 to other applications, such as any kind of mixer or distribution infrastructure.

Figure 5:
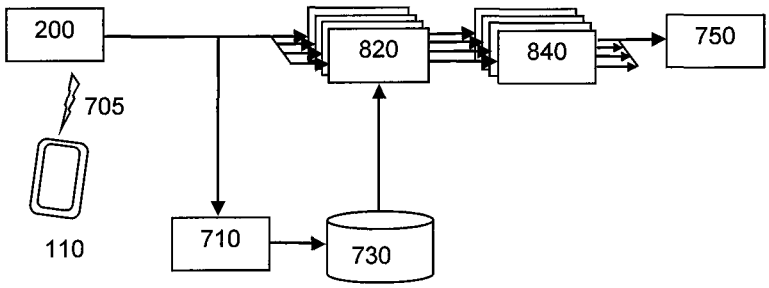
FIG. 5 a multi-channel signal processing structure.

FIG. 5 shows an exemplary multi-channel signal processing structure. Different from the single-channel masking application shown in FIG. 4, a bank of spatially aware signal detectors 820 is used to feed different signal processing chains that may work in parallel. The different signal processing chains may use one or more signal processors 840. Thereby different effects may be applied to separate regions.

The invention is advantageous for microphone arrays, and in particular for microphone arrays that use automatic beam focusing.

It is clear that various embodiments described above can be combined fully or partially. Even if such combination is not mentioned in detail herein, it is intended to be considered an embodiment of the present invention.

The invention claimed is:

1. A method for automatically configuring a microphone array, the microphone array comprising a plurality of microphone capsules, the method being performed by the microphone array and comprising:

scanning sound signals from a plurality of directions by combining output signals of said plurality of microphone capsules;

detecting a sound signal from a first direction and detecting the first direction;

determining that the detected sound signal corresponds to a first predefined control sound signal, the first predefined control sound signal being one of a group of at least two predefined control sound signals and comprising a first tone sequence that is automatically generated;

decoding the first tone sequence by a configuration controller, wherein a first electronic control signal according to the first tone sequence is obtained; and providing the first electronic control signal to a directivity controller of the microphone array, the directivity controller being adapted for configuring the microphone array according to the first electronic control signal;

wherein the configuring comprises:

eliminating the first direction from scanning sound signals when the first tone sequence is a first predefined tone sequence, and cancelling an elimination of a second direction from scanning sound signals when the first tone sequence is a second predefined tone sequence different from the first predefined tone sequence, the second direction being different from the first direction.

2. The method according to claim 1, further comprising:

detecting a second sound signal from a third direction and detecting the third direction;

determining that the detected second sound signal corresponds to a second predefined control sound signal of the group of predefined control sound signals, the second predefined control sound signal being different from the first predefined sound signal and comprising a second tone sequence different from the first tone sequence;

decoding the second tone sequence by the configuration controller to obtain a second electronic control signal according to the second tone sequence; and providing the second electronic control signal to the directivity controller, the directivity controller being further adapted for configuring the microphone array according to the second electronic control signal;

wherein the configuring according to the second electronic control signal is different from the configuring according to the first electronic control signal and comprises:

eliminating the third direction from scanning sound signals when the second tone sequence is the first predefined tone sequence, and cancelling an elimination of a fourth direction from scanning sound signals when the second tone sequence is the second predefined tone sequence different from the first predefined tone sequence, the fourth direction being different from the third direction, and modifying a processing of sound signals coming from the third direction when the second tone sequence is a third predefined tone sequence different from the first and second predefined tone sequences.

3. The method according to claim 2, wherein said modifying a processing of sound signals coming from the third direction comprises modifying an amplification of the sound signals.

4. The method according to claim 1, wherein said determining that the detected sound signal corresponds to a predefined control sound signal comprises comparing parameters of the detected sound signal with stored parameters of the predefined control sound signal.

5. The method according to claim 1, wherein the detected sound signal comprises an audio signature and is reproduced by an electronic device and is not a speech signal.

6. The method according to claim 5, wherein the electronic device is a portable computer or a smart phone.

7. The method according to claim 1, wherein said scanning sound signals from a plurality of directions uses a grid of predefined probe points, and said eliminating the first direction from scanning sound signals comprises deactivating at least one probe point, and said cancelling an elimination of a second direction from scanning sound signals comprises activating at least one deactivated probe point.

8. The method according to claim 1, wherein the second direction is adjacent to the first direction.

9. The method according to claim 1, further comprising:

providing detected sound signals to a speech output, wherein sound signals of said group of predefined control sound signals are not provided to the speech output.

10. A configurable microphone array, comprising:

an array of microphones comprising a plurality of microphone capsules and having a configurable directivity;

a directivity controller adapted for controlling the configurable directivity of the microphone array; and a configuration controller adapted for determining that a sound signal detected by the array of microphones corresponds to a first predefined control sound signal, the first predefined control sound signal being one of a group of at least two predefined control sound signals and comprising a first tone sequence that is automatically generated, and further adapted for configuring the directivity controller according to the first predefined control sound signal, wherein the configuring comprises:

eliminating the first direction from scanning sound signals when the first tone sequence is a first predefined tone sequence, and cancelling an elimination of a second direction from scanning sound signals when the first tone sequence is a second predefined tone sequence different from the first predefined tone sequence, the second direction being different from the first direction.

11. The microphone array according to claim 10, wherein the configuration controller comprises:

a direction detector adapted for detecting a first direction from which the sound signal is detected;

a comparator adapted for comparing the detected sound signal with at least one predefined control sound signal, and for determining that the detected sound signal corresponds to said first predefined control sound signal; and a control signal generator adapted for generating a first electronic control signal according to the first predefined control sound signal, wherein the first electronic control signal configures the directivity controller according to the first direction.

12. The microphone array according to claim 10, further comprising:

a storage adapted for storing data defining one or more predefined control sound signals;

wherein the configuration controller comprises:

a comparator adapted for comparing the detected sound signal with the one or more predefined control sound signals stored in the storage, and for determining that the detected sound signal corresponds to said first predefined control sound signal; and a control signal generator adapted for generating a first electronic control signal according to the first predefined control sound signal, wherein the first electronic control signal configures the directivity controller.

13. The microphone array according to claim 10, wherein the configuration controller is further adapted for determining that a sound signal detected by the array of microphones corresponds to a second predefined control sound signal different from the first predefined control sound signal, the second predefined control sound signal being one of said group of predefined control sound signals and comprising a second tone sequence that is automatically generated, the configuration controller being further adapted for configuring the directivity controller according to the second predefined control sound signal, wherein the configuration controller is further adapted for:

configuring the directivity controller to generate a directivity of the microphone array that omits the first direction when the second tone sequence is a first predefined tone sequence, configuring the directivity controller to cancel a previously configured omission of a third direction in the directivity of the microphone array, the third direction being different from the second direction when the second tone sequence is a second predefined tone sequence different from the first predefined tone sequence, and modifying a processing of sound signals coming from the third direction when the second tone sequence is a third predefined tone sequence different from the first and second predefined tone sequences.

14. The microphone array according to claim 10, wherein the second direction is adjacent to the first direction.

15. The microphone array according to claim 10, further comprising:

a speech output, wherein detected sound signals are provided to the speech output, and wherein sound signals of said group of predefined control sound signals are not provided to the speech output.

16. A non-transitory computer-readable storage medium having stored thereon instructions that when executed on a computer cause the computer to perform a method for configuring a microphone array according to claim 1.

* * * * *